US005229727A

United States Patent [19]

Clark et al.

[11] Patent Number: 5,229,727

[45] Date of Patent: Jul. 20, 1993

[54] HERMETICALLY SEALED MICROSTRIP TO MICROSTRIP TRANSITION FOR PRINTED CIRCUIT FABRICATION

[75] Inventors: Richard D. Clark, Delran, N.J.; John A. MacDonald, Jordan; John A. Windyka, Liverpool, both of N.Y.; Leonard H. Yorinks, Cherry Hill; Stephen C. Miller, Haddonfield, both of N.J.

[73] Assignee: General Electric Company, Syracuse, N.Y.

[21] Appl. No.: 850,809

[22] Filed: Mar. 13, 1992

[51] Int. Cl.[5] ..... H01P 5/00

[52] U.S. Cl. ..... 333/33; 333/238; 333/246

[58] Field of Search ..... 333/33, 238, 246, 247; 357/74, 80

[56] References Cited

U.S. PATENT DOCUMENTS

| | | | |
|---|---|---|---|
| 4,276,558 | 6/1981 | Ho et al. | 333/247 X |
| 4,494,083 | 1/1985 | Josefsson et al. | 333/246 X |
| 4,543,544 | 9/1985 | Ziegner | 333/238 X |
| 4,816,791 | 3/1989 | Carnahan et al. | 333/33 |
| 4,901,041 | 2/1990 | Pengelly | 333/246 X |
| 5,057,798 | 10/1991 | Moye et al. | 333/33 |

*Primary Examiner*—Paul Gensler

*Attorney, Agent, or Firm*—Paul Checkovich; Stephen A. Young

[57] ABSTRACT

The transition interconnects microstrip transmission lines whose finite-width conductors are formed on the upper surface and whose ground planes are formed on the under surface of a ceramic substrate. A patternable metallizable multilayer thick film dielectric is applied to the under surface of the ceramic substrate. The transition comprises first and second vias which penetrate the ceramic substrate inside and outside a hermetic enclosure. The upper ends of the vias are connected to the finite-width transmission line conductors, and the lower ends of the vias are interconnected by a finite-width conductor formed on the under surface of the substrate. The lower conductor then forms a transmission line of either a microstrip or coplanar nature with a ground plane available on the underside of the assembly. The thick film dielectric facilitates sealing, and attachment of a metal base plate. All steps are performed using thick film processing.

11 Claims, 7 Drawing Sheets

FIG. 1B UPPER SURFACE METALIZATION OF ALUMINA SUBSTRATE 14
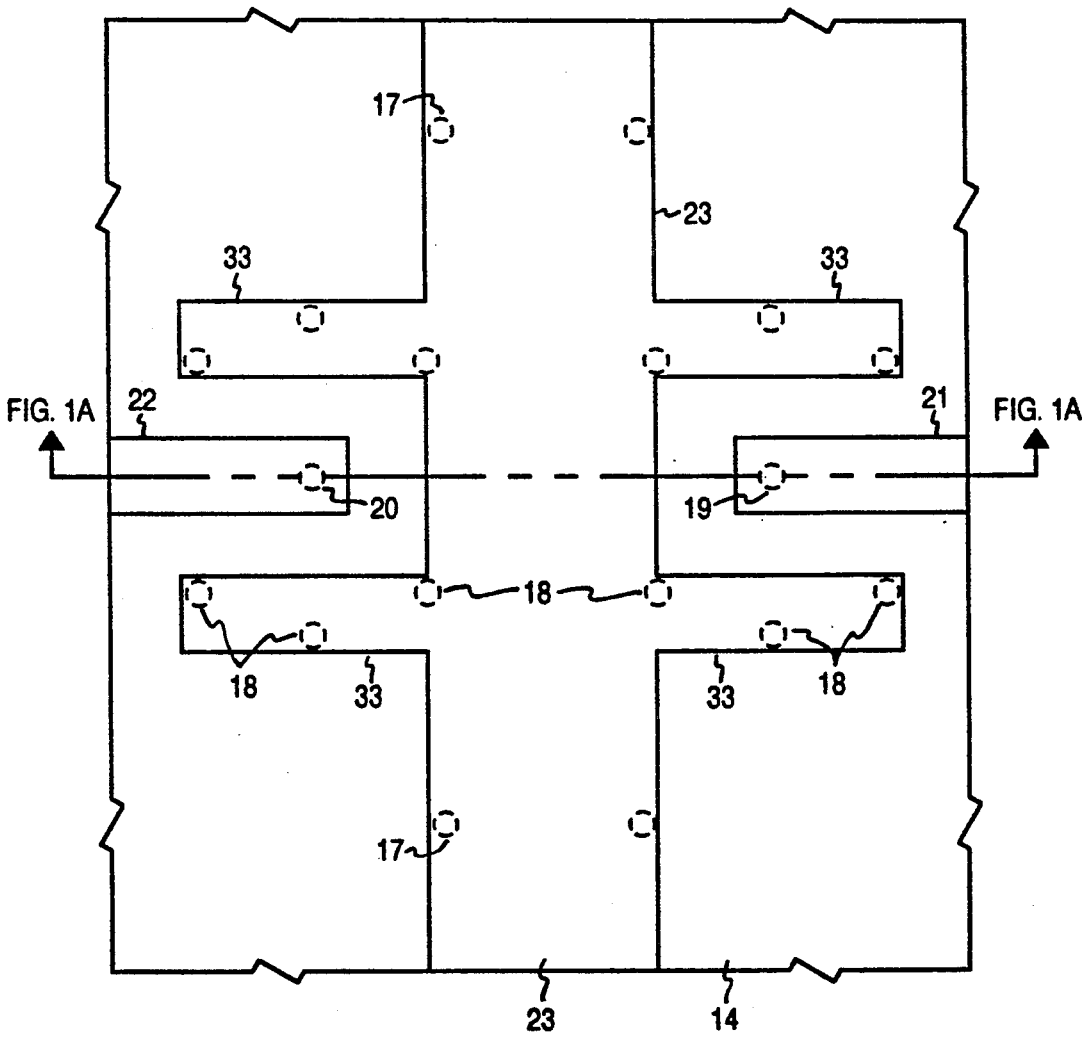

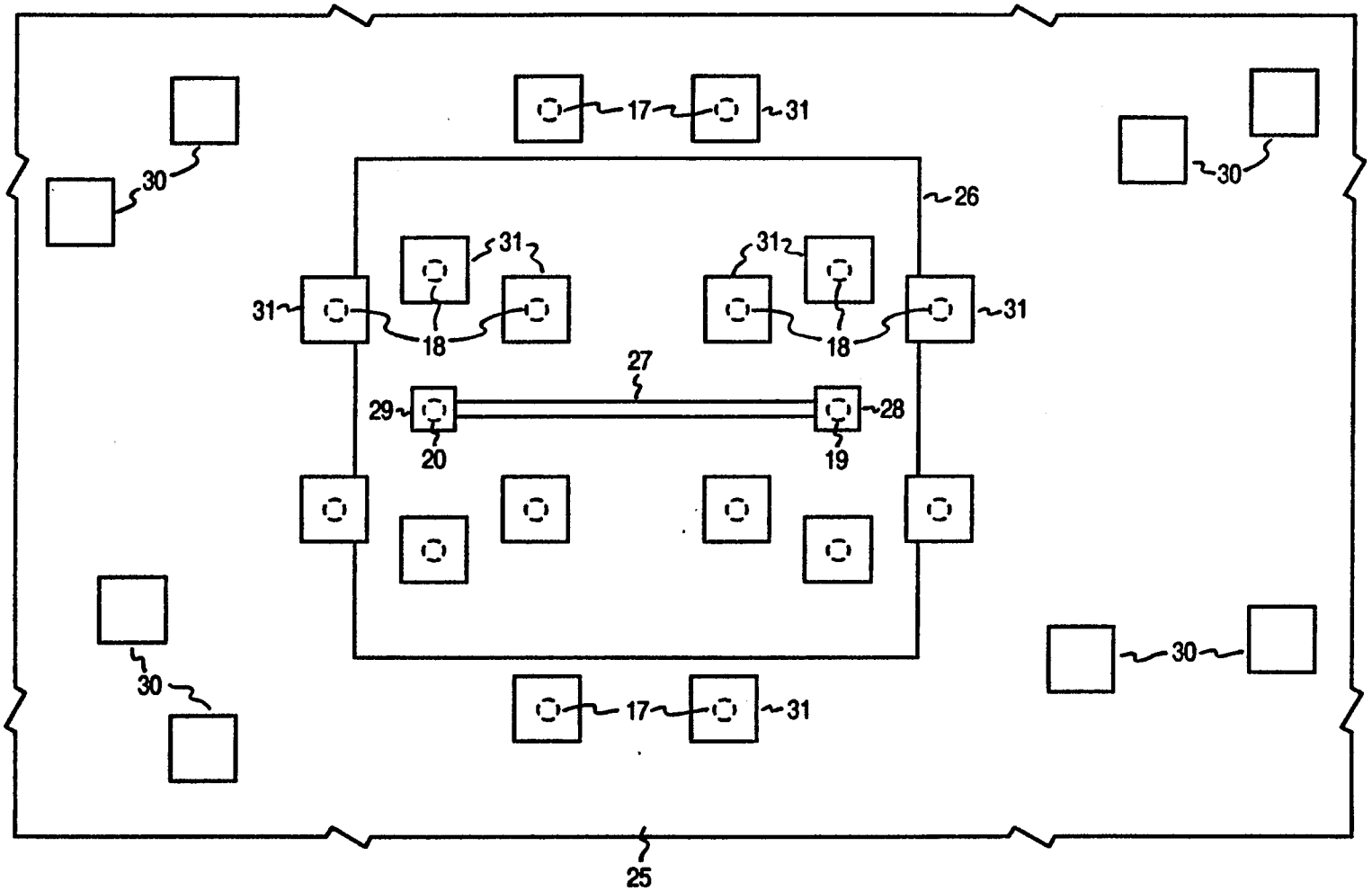
FIG. 1C UNDER SURFACE METALLIZATION ON ALUMINA SUBSTRATE 14

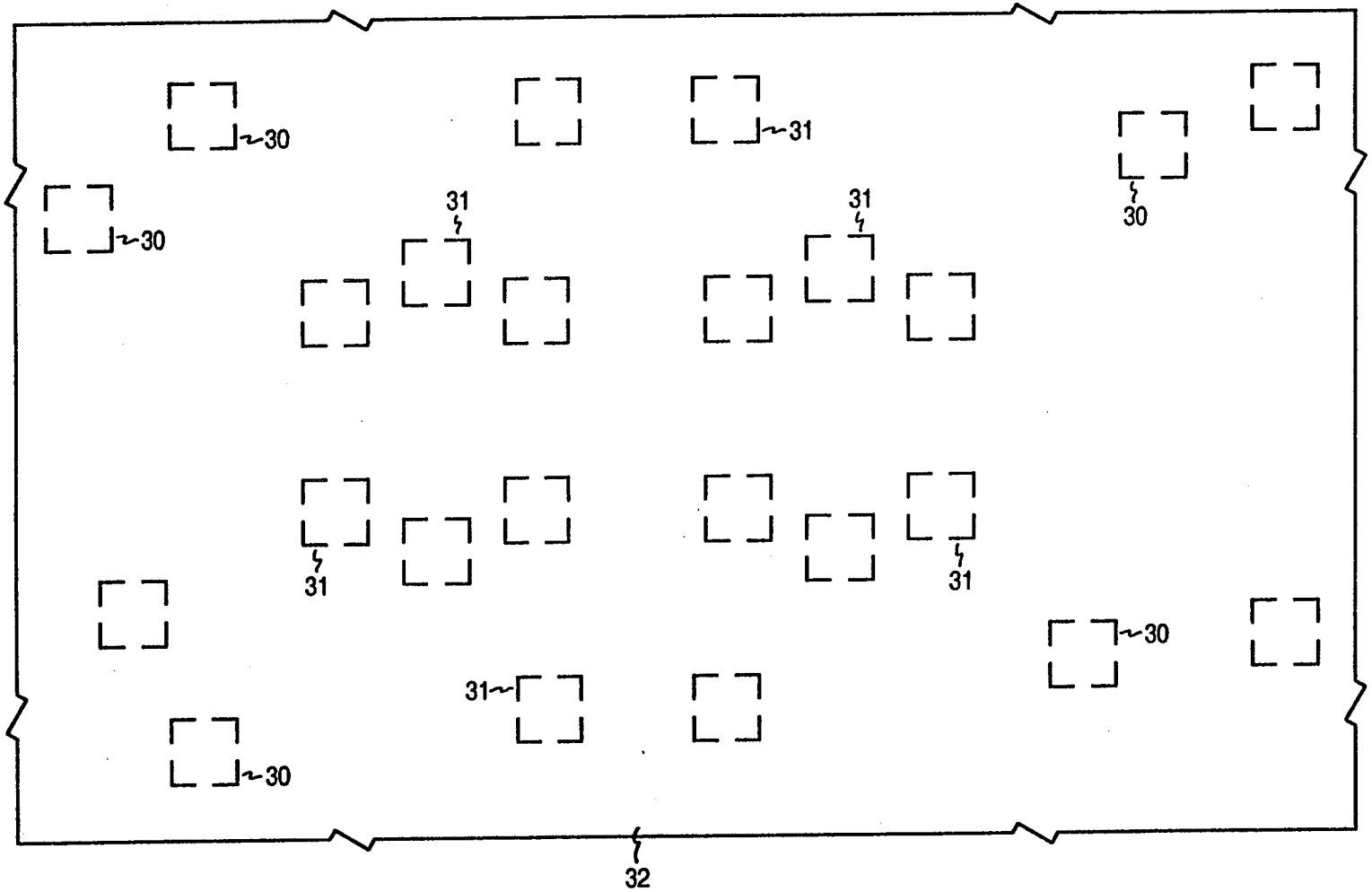
FIG. 1D UNDER SURFACE METALLIZATION ON DIELECTRIC LAYER 15

HERMETICALLY SEALED MICROSTRIP TO MICROSTRIP TRANSITION FOR PRINTED CIRCUIT FABRICATION

BACKGROUND OF THE INVENTION

1. Field of the Invention

The invention relates to microstrip to microstrip transitions and more particularly to a transition designed to traverse a hermetic seal and to be fabricated using printed circuit techniques.

2. Prior Art

Microstrip transmission lines are a common form of transmission line in high frequency circuits. The microstrip transmission line is the transmission line of choice in high frequency circuits requiring active components or the inclusion of monolithically integrated circuits in a hybrid mode of assembly. In such applications the provision of a conductor formed on the upper surface of a ceramic substrate having a ground plane on its under surface, provides an efficient and convenient mode of high frequency transmission and is the conventional choice for active circuits.

Microwave electronics circuits with multiple chips now generally require a hermetic and often an RF shielding enclosure. When such an enclosure is required, efficient means must be provided for coupling RF signals to and from the enclosed electronics circuits.

Since printed circuit techniques are used to pattern the microstrip lines between the circuits within the hermetic enclosure, it is desirable to form the transition using the same processing steps.

The "modules" as these hermetically packaged electronic assemblies are frequently called, typically employ an alumina substrate to which integrated circuits (MMICs at high frequencies) ar bonded and which have microstrip conductors on their upper surfaces and a general ground plane on their under surfaces for point to point high frequency transmission. Below the ground plane a multilayer thick film dielectric is often added to the assembly to supply the energization and provide low frequency control signals. The thick film dielectric usually consists of several dielectric layers each supporting a patterned metallization applied by standard thick film techniques.

SUMMARY OF THE INVENTION

Accordingly it is an object of the present invention to provide a microstrip to microstrip transition which may be used to couple RF energy through a hermetically sealed enclosure without impairing the hermeticity, and which uses steps conventional to thick film processing.

These and other objects of the invention are achieved in a combination which comprises a first microstrip transmission line disposed on a ceramic substrate within a hermetic enclosure, and a second microstrip transmission line disposed outside the hermetic enclosure. Each microstrip transmission line comprises a conductor of finite width patterned from a first metallization on the upper surface of the substrate, the substrate and a ground plane also patterned from a second metallization on the under surface of the substrate.

The combination further comprises a first and a second transitioning transmission line element comprising a first and a second via hole, one inside and the other outside of the enclosure penetrating the substrate and sealed with conductive material, the upper ends being joined to the first and second conductors respectively.

Also included is a third transitioning transmission line element which comprises a third conductor of finite width patterned from the second metallization, placed in an opening in the second metallization and joined at one end to the first filled via hole and at the other end to the second filled via hole. Thick film dielectric is then applied to the under surface of the dielectric to seal the under surface and a metal film is applied to the dielectric to form a solderable surface for attachment of a metal base plate.

In accordance with a first embodiment of the invention, the metal film underlies the third transmission line element establishing a substantial RF field between the two and supporting a microstrip mode of transmission.

In accordance with a second embodiment of the invention, the metal film applied to the dielectric is omitted and the base plate is cut away in the vicinity of the transition to avoid significant RF fields with the third conductor. Instead, the second metallization is patterned to form a transmission line element forming coplanar RF fields on either side of the third conductor.

Both embodiments perform well at microwave frequencies, with the second embodiment being simpler to fabricate. The three transitioning elements are readily fabricated using thick film techniques and readily "tuned". The vias which exhibit substantial inductance may be compensated by adjusting the patterns of the third conductor to provide a corrective capacitance for the selected band of operation. Once optimized, the printing retains the necessary accuracy to insure good performance.

BRIEF DESCRIPTION OF THE DRAWINGS

The inventive and distinctive features of the invention are set forth in the claims of the present application. The invention itself, however, together with further objects and advantages thereof may best be understood by reference to the following description and accompanying drawings, in which:

FIGS. 1A–1D are views of a microstrip line to microstrip line transition formed on a ceramic substrate for transferring RF energy through a hermetic enclosure in accordance with a first embodiment of the invention; FIG. 1A is a cross section view taken along line 1A–1A of FIG. 1B; FIG. 1B is a plan view of the metallization on the upper surface of the ceramic substrate; FIG. 1C is a plan view of the metallization of the under surface of the ceramic substrate; and FIG. 1D is a plan view of the under surface metallization of a multilayer thick film dielectric applied to the under surface of the ceramic substrate; FIG. 2A is a cross section; FIG. 2B is a plan view illustrating the upper surface metallization on the ceramic substrate; and FIG. 2C is a plan view illustrating the under surface metallization on the ceramic substrate taken along line 2C–2C of FIG. 2A.

DESCRIPTION OF THE PREFERRED EMBODIMENT

Figure 1A:
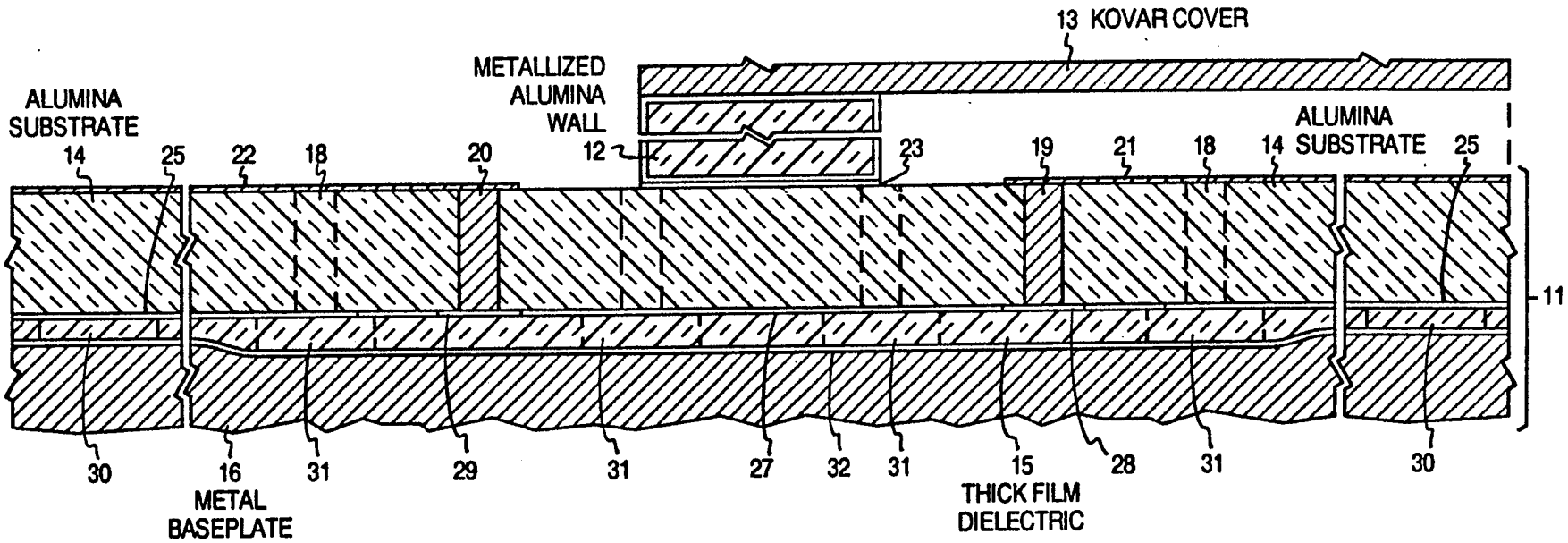

FIGS. 1A through 1D illustrate a strip line to strip line transition in accordance with a first embodiment of the invention. The illustrated embodiment is designed for use at five Gigahertz, exhibits a characteristic impedance of 50 ohms and performs the function of transferring RF signals between electronic circuits contained within a hermetically sealed enclosure and circuits outside the enclosure. Assuming that the function performed by the contained electronic circuits is complex, and several integrated circuit chips are enclosed, typically monolithic microwave integrated circuits (MMICs) at these frequencies, the arrangement may be called a "module".

While the enclosure through which the transition operates is only partially illustrated in FIGS. 1A to 1D, it is closed on all sides, and comprises a module base assembly 11, four walls 12, and a cover 13. All three are of gas impermeable materials suitable for forming a hermetic enclosure, and all three are hermetically sealed together.

The module base assembly 11 consists of a 25 mil thick alumina substrate 14, having patterned metallizations on both surfaces and penetrated by a substantial number of conductive vias, an underlying thick film dielectric layer 15 from 3.5 to 6 mils in thickness having a patterned metallization on its undersurface and penetrated by a substantial number of conductive vias, and a metal base plate 16 of substantial thickness.

A hermetic enclosure is achieved by proper selection of hermetic materials and by care in forming the seals and vias. Alumina substrate material is readily available in a gas impermeable form. The introduction of vias requires care in maintaining hermeticity, but with care, as will be detailed, hermeticity may be assured.

A further requirement for the module is that the contained electronics be shielded from stray R fields and not radiate. This dictates that the principal surfaces of the enclosure be conductive so as to minimize or eliminate RF leakage. Thus assuming that an alumina substrate is used to support MMIC chips and to provide a surface for interconnecting metallizations, the alumina will in turn be supported upon a metal base. In addition, one may often use either a coefficient of thermal expansion CTE matched metal clad ceramic or a CTE matched metal component to complete the enclosure. In the present embodiment, the metal base plate 16 may be of a copper-molybdenum-copper clad construction or a tungsten copper metal matrix composite which is CTE matched to alumina. The walls 12 are preferably of alumina because of the desire for a close CTE match to the alumina substrate to avoid warping, with Kovar being a second choice. The alumina wall is coated with a solderable conductive coating having an undercoating of a refractory metal such as molybdenum-manganese, followed by nickel and gold to provide solderability. The cover 13 may either be of Kovar, CTE matched to alumina or alumina metallized with a solderable metallic coating on the undersurface.

Prior to assembly, the alumina substrate 14 is laser drilled with 8 mil holes in preparation for forming conductive vias. The vias 17–20 are used in forming the microstrip line to strip line transition and for grounding the walls 12. The holes for the vias are then filled with metal using a thick film process. The via metallization step is repeated to insure that the vias are hermetically sealed.

Next the top side and back side metallizations are applied to the alumina substrate. The top side metallization, shown in FIG. 1B is in three parts which are simultaneously applied. The first part forms the first microstrip conductor 21 of the transition. The conductor 21 is a rectangular metallization which extends from the right edge of the illustration and terminates over the via 19, making electrical contact with it and avoiding contact with the six vias 18 which surround the via 19, and which are grounded to the metal base plate 16.

The second part (23, 33) of the top side metallization has one portion (23) which extends from top to bottom of the figure and conforms to the outlines of the wall 12 and a second portion (33) consisting of four extensions which connect the six vias 18 on either side to the wall metallization 23. The first portion 23 forms a solderable surface for sealing the alumina substrate 14 to the wall 12. The extensions 33 ground the upper ends of the vias 18 to the wall grounding metallization 23. As illustrated in FIGS. 1A, 1C and 1D, the lower ends of vias 17 and 18 also are connected to the under surface metallization 25, which is in turn connected to the square vias 31, penetrating the dielectric 15, to make contact through metallization 32 to the base plate 16 providing the final ground.

The third part of the top metallization forms the second microstrip conductor 22. The third part extends from the left edge of the illustration and terminates over the via 20, making contact with it and avoiding contact with the six vias 18 which surround the via 20 and which are grounded to the metal base plate 16. (As shown in FIG. 1A, the vias 17 and 18 continue through a dielectric layer 15 applied to the backside of the alumina substrate, and in that way make contact with the metal base plate 16.)

The back side metallization of the alumina substrate is illustrated in FIG. 1C. It is in two parts which are formed by a single metallization. The first part is a general ground plane 25 which extends outside of the wall region, with a rectangular opening 26 in the region of the strip line to strip line transition. That opening is made large enough to avoid interference with the fields of the transition. The ground plane 25 makes contact with all the vias not within the opening 26. Thus it contacts four of the vias 18 associated with the transition vias 19 and 20, and four vias 17. In addition the metallization 25 contacts the eight vias 30 found in the dielectric layer 15. The vias 30, which are shown in both FIGS. 1C and 1D, connect the backside metallization 25 to the metal base plate.

The second part of the backside metallization is the conductor (27, 28, 29) forming a portion of the transition interconnecting the vias 19 and 20. The conductor has a long, relatively narrow portion 27, typically 100 mils in length by 5.5 mils in width terminating at the right in a square 15 mil×15 mil pad 28 connected to the via 19 and terminating at the left in a square pad 29 connected to the via 20.

The dielectric layer 15 and vias are formed on the underside of the alumina substrate 14. The process is a photographically patterned "thick film" process in which a layer of dielectric is laid down at a thickness of approximately 0.5 mils, and repeated seven times to complete the 3.5 mil thick dielectric layer in the region surrounding the transition. Under the microstrip transition, the process is repeated five more times to achieve a 6 mil thick dielectric layer. A suitable material is DuPont 5704 which is a lead boron silicon based glass formulated for compatibility with a gold metallization. The material has a dielectric constant of 8–10 and the six mil thickness permits characteristic transmission line impedance of 50 ohms with the conductor 27 having a 5.5 mil thickness. All of the vias illustrated in FIG. 1C, except for 19 and 20, are extended through the dielectric layer for contact with the metal base plate 16. The process entails leaving voids in the dielectric layer, metallizing the voided area and repeating the process until the full thickness is built up with both dielectric and metallizations. Finally, expanded pads typically 25 mils×25 mils, as shown at 31, are provided in the last via metallization step to insure electrical continuity, prior to forming a general metallization 32 over the entire dielectric layer. The metallization 32 provides a final surface for soldering the dielectric layer 15 to the metal base plate 16.

The soldering of the metallization 32, itself a part of the alumina thick film dielectric sub-assembly to the metal base plate 16 represents the last step in forming the module base assembly. The metal base plate as illustrated is recessed under the transition to a depth of 2.5 mils. This recess is shallow, and may be accomplished either by a stamping or milling process.

Assembly of the hermetic enclosure is the next step.

Assembly of the hermetic enclosure requires care in sealing the walls to the upper surface of the alumina substrate and sealing the cover to the walls. The walls 12, which are preferably alumina with surface metallizations, are solder sealed to the metallization 23 on the upper surface of the alumina substrate 14. The walls 12 surround the area of the substrate requiring hermetic enclosure. This area is allocated to the integrated circuits (MMICs), interconnecting metallizations, and portions of the microstrip to microstrip transitions intended to traverse the hermetic enclosure.

The cover 13, which is solder sealed to the walls 12, completes the hermetic enclosure. The cover 13 may be of either a metal or a metallized ceramic, CTE matched to the walls of the enclosure.

The microstrip to microstrip transition has been formed using process steps which are an incident to the normal fabrication of the module.

The microstrip transmission line within the hermetic enclosure consists of the finite width conductor 21 and the adjacent ground plane 25 both applied to the alumina substrate, which provides the medium in which the principal RF fields exist. Similarly the microstrip transmission line outside of the hermetic enclosure consists of the finite width conductor 22 and another adjacent portion of ground plane 25, both applied to the alumina substrate, which provides the medium in which the principal RF fields exist.

The two strip lines (21, 14, 25; 22, 14, 25) are interconnected by the transition, which consists of three transmission line elements.

The first transmission line element, starting from within the hermetic enclosure is the via 19 which plunges from the top surface conductor 21 to the bottom surface conductor, pad 28. The via 19 is at the center of the six vias (18) which are grounded to the metal base plate 16. These vias prevent the occurrence of a double plate mode, which might propagate RF energy through the thickness of the substrate, but their arrangement does not support a conventional TEM coaxial mode. The via 19 is 8 mils in diameter and 25 mils in length giving an inductance of 0.3 microhenries. At five Gigahertz this inductance is significant, and must be compensated.

The second transmission line element, starting from outside the hermetic enclosure is the via 20 which plunges from the top surface conductor 22 to the bottom surface conductor pad 29. The via 20 is at the center of the six vias (18) which are grounded to the metal base plate 16. These vias prevent the occurrence of a double plate mode, which might propagate RF energy through the thickness of the substrate, but do not support a conventional TEM coaxial mode. The via 20 is also 8 mils in diameter and 25 mils in length giving an inductance of 0.3 microhenries. This inductance is significant, and must be compensated.

The third transmission line element consists of the conductor 27, 28, 29 which connects the two vias, and in the presence of the metal base plate 16, functions substantially as a microstrip element. There appears to be some small RF field formed with the wall metallization 23, but the effect does not appear to be large. The back surface conductor 27 terminates with two widened areas 28, 29 which act as, a capacitor to tune out the effect of the inductance over the desired 5 to 6 gHZ operating band.

The transition so far described has a return loss of less than 19 dB and an insertion loss of less than 0.15 dB over the 5 to 6 gHZ band.

The model suggests a baseline width of 5.5 mils, a length of 100 mils and a dielectric thickness of 6 mils to optimize both insertion loss and return loss. A study of the variances (sensitivity analysis) indicates that a wider line (7 mils versus baseline of 5.5 mils) would improve the insertion loss from 0.15 dB to 0.10 dB while degrading the return loss from 19 dB to 18 dB. A narrower line (4 mils versus baseline of 5.5 mils) will maintain insertion loss at 0.15 dB while degrading return loss from 19 dB to 16 dB. Should the dielectric layer be increased in thickness from a baseline of 6 mils to 7 mils, insertion loss improves to about 0.08 dB, while return loss degrades by about 1 dB to 18 dB: For a thinner substrate, 4 mils instead of the baseline value of 5.5 mils, the return loss degrades by 2 dB to 17 dB and the insertion loss improves by 0.05 dB to 0.10 dB.

Figure 2A:
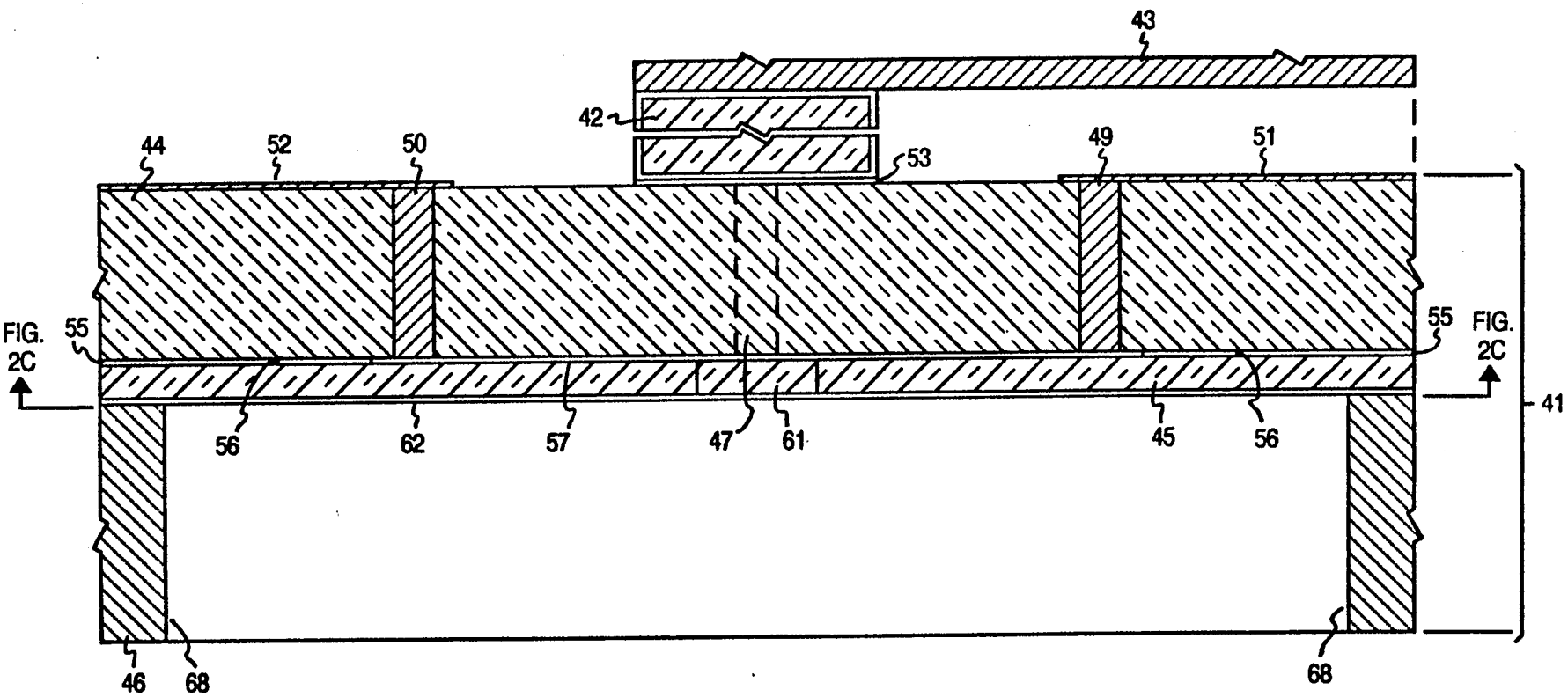
FIGS. 2A–2C are views of a microstrip line to microstrip line transition also formed on a ceramic substrate, in accordance with a second embodiment of the invention.
Figure 2B:
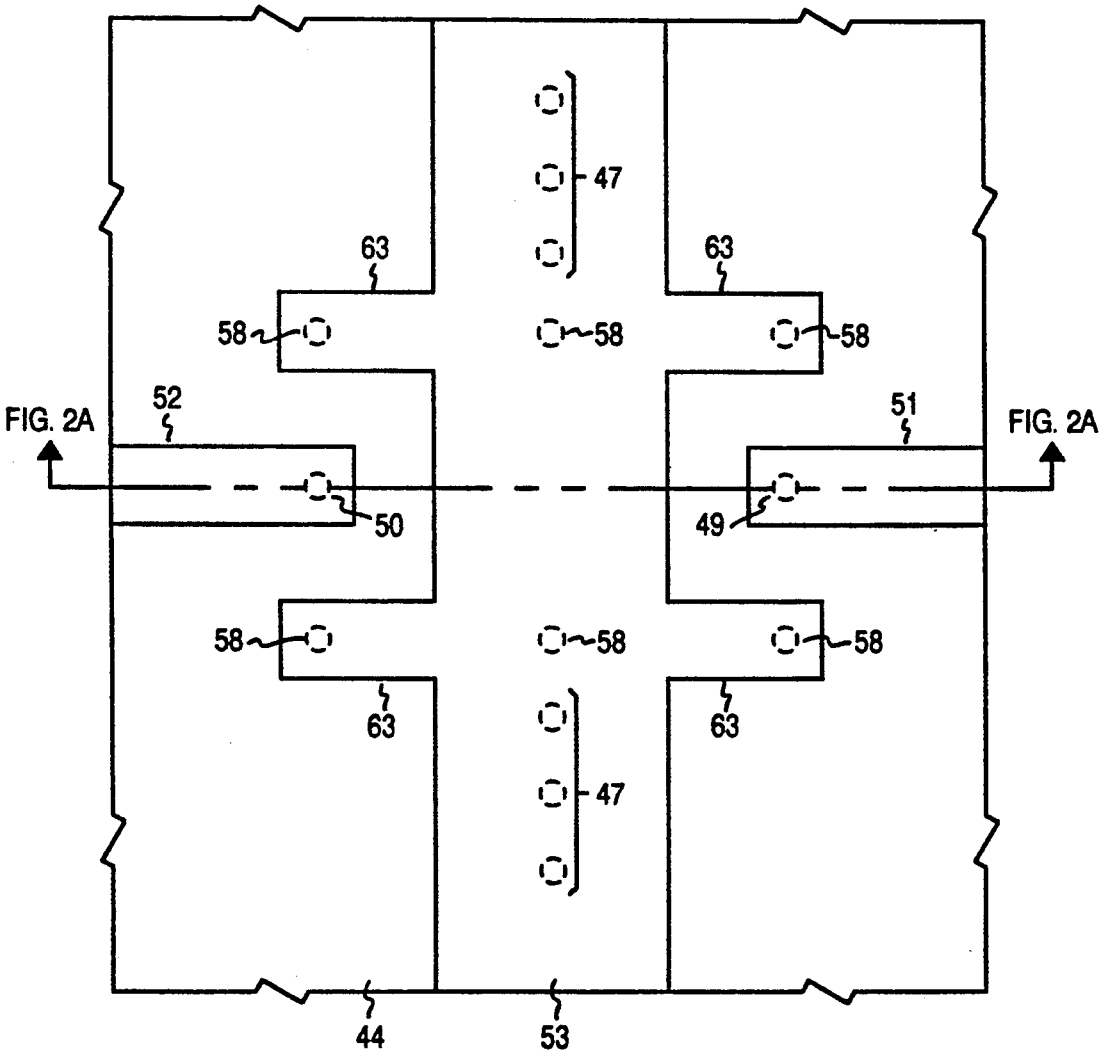
Figure 2C:
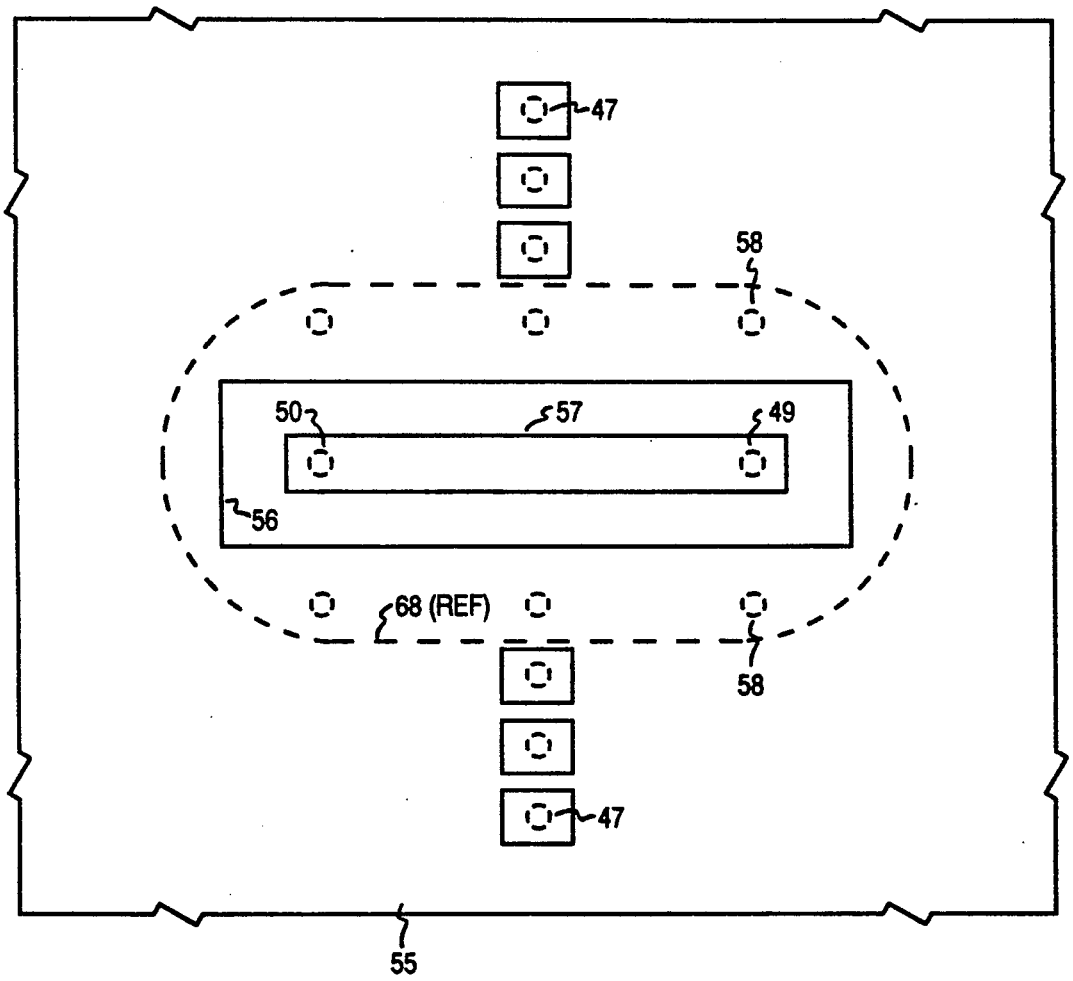

A second embodiment of the invention having equivalent electrical performance to the first embodiment, while being simpler to fabricate and tune is illustrated in FIGS. 2A–2C.

A cross-section of the second embodiment is illustrated in FIG. 2A. As shown, the base assembly 41 of the second embodiment consists of an alumina substrate 44, 25 mils in thickness, a thick film multi-layer dielectric film 45 of a glass suitable for use with a gold metallization, and metal base 46, 0.040" thick, which is cut-out under the transition. The cut-out reduces the proximity of a grounded conductor to the transmission line elements on the underside of the substrate, and permits use of a wider conductor 57. The hermetic enclosure is formed using a wall 42 of alumina with a metallized surface and a Kovar cover 43, all soldered together, as previously described.

The alumina substrate 44 of the FIG. 2 embodiment is provided with a patterned top side metallization, a patterned back side metallization and vias which are used in formation of the transition. The top side metallization is shown in FIG. 2B. The wall bonding metallization 53 on the substrate is 80 mils wide to provide a 10 mil margin to facilitate soldering the wall, which is 60 mils wide, to the substrate. In addition, four metallization areas 63 are provided which connect the metallization 53 to vias 58 leading to the grounded back side metallization 55, and which flank the microstrip conductors 51 and 52. The grounded vias 58 suppress the parallel plate mode at the transition. The wall bonding metallization 53 is also grounded to the metal base plate by a line of vias 47 spaced along the center line of the wall.

The back side metallization 55 as shown in FIG. 2C forms a continuous ground plane except beneath the transition, where a rectangular moat 56 is provided. The conductor 57, interconnecting vias 49, 50 is disposed at the center of the moat, with approximately equal spacing to each wall of the moat 56. The moat 56 and conductor 57 are also set within a larger cut-out 68 in the metal base plate. As illustrated in FIG. 2C, six vias (two-47; four-58) are provided within the cut-out, which are grounded to the back surface metallization 55 of the substrate. The six vias 47 outside of the cut-out which ground the wall should be extended down through the thick film multilayer dielectric in the manner illustrated in FIG. 1A.

The transition in the second embodiment also involves three elements. The microstrip conductor 51 to the right connects to the via 49, a first element of the transition. The via 49 passes through the alumina substrate and connects to the right end of the back side conductor 57, which forms the third element of the transition. Similarly the microstrip conductor 52 on the left connects to the via 50, a second element of the transition. The via 50 connects to the left end of the back side conductor 57. The two grounded vias 58 to either side of the signal vias 49 and 50 suppress parallel plate moding. The back side conductor is principally a coplanar transmission line with the RF electric field between the center conductor and the coplanar ground across opening 56. The use of a coplanar transmission line allows the use of a wider (0.014 mil) center conductor than the microstrip in the first embodiment. Significant RF fields do exist between the center conductor 57 and the wall metallization 53, which reduces (by about 30%) the impedance of the coplanar line from the pure coplanar value. The larger width conductor is more easily patterned using conventional thick film printing. In addition, the tuning out of the inductance of the vias 49 and 50 may be done by letting the conductor 57 over shoot the vias by a predetermined amount. A second control is by adjusting the width of the gap between the conductor 57 and the edges of the opening 56.

The removal of the ground plane on the under surface of the transition by use of the cut-out 56 in the metal base plate facilitates using a wider conductor 57, which simplifies its formation by a conventional printing step. The absence of a double ground under the transition, also avoids the need for stitching the back surface metallization to the base plate in that region.

The second embodiment has an insertion loss, which is less than 0.15 dB and a return loss which is greater than 20 dB over a 5 to 6 Gigahertz band width.

The transition illustrated in FIGS. 2A–2C is utilized in a module in which the multilayer thick film dielectric is an essential part of the power and logic circuitry used to control the module. The additional layers of dielectric 45 under the transition affect the design parameters slightly and facilitate hermetically sealing the vias which lie within the cut-out in the metal base plate, but are not essential otherwise.

What is claimed is:

1. A microstrip to microstrip transition through an hermetic enclosure comprising in combination:

A) a gas impermeable dielectric substrate, having patterned first and second metallizations on the upper and under surfaces, respectively B) a gas impermeable cover having a metallized under surface, C) a gas impermeable wall having conductive metal surfaces, solder sealed along the bottom to the first metallization and along the top to the metallization on said cover to hermetically enclose a portion of said substrate, D) a first and a second microstrip transmission line disposed upon said dielectric substrate, the first within and the second outside of said hermetic enclosure, respectively comprising (i) a first and a second conductor of finite width patterned from said first metallization, (ii) said dielectric substrate, and (iii) a ground plane patterned from said second metallization, E) a first and a second transitioning transmission line element respectively comprising a first and a second via hole, respectively within and outside of said enclosure, penetrating said dielectric substrate, and filled with conductive material, the upper ends thereof being joined to said first and second conductors respectively, and F) a third transitioning transmission line element on the underside of said substrate for interconnecting said first and second transitioning transmission line elements, comprising a third conductor of finite width patterned from said second metallization, placed in an opening in said second metallization and joined at one end to said first filled via hole and at the other end to said second filled via hole.

2. The arrangement set forth in claim 1, having in addition thereto:

A) a dielectric layer applied to the under surface of said substrate to seal the under surface;

B) a metal film applied to said applied dielectric layer; and

C) a metal base plate soldered to said metal film and connected to said patterned second metallization, said metal base plate establishing a substantial RF field with said third conductor.

3. The arrangement set forth in claim 2, wherein said dielectric layer is a photolithographically patterned glass material suitable for thick film processing and subsequent metallization.

4. The arrangement set forth in claim 3, wherein said third conductor is patterned at the joints to said via holes to provide shunt capacitance to compensate for the inductance of said via holes over a desired band of frequencies.

5. The arrangement set forth in claim 4, wherein via holes are provided adjacent said first and said second via holes respectively, and grounded to said metal base plate for suppression of parallel plate modes in said substrate.

6. The arrangement set forth in claim 5, wherein said first metallization is patterned to be coextensive with said wall to facilitate bonding said wall to said dielectric substrate, and wherein vias are provided to connect the wall to the metal base plate.

7. The arrangement set forth in claim 1, wherein said transitioning third transmission line also comprises a coplanar ground spaced from said third conductor of finite width and patterned from said second metallization to establish substantial coplanar RF fields.

8. The arrangement set forth in claim 7, wherein the metallization on said wall forms with said third conductor significant RF fields through said dielectric.

9. The arrangement set forth in claim 8, wherein said third conductor is patterned at the joints to said via holes to provide shunt capacitance to compensate for the inductance of said via holes over a desired band of frequencies.

10. The arrangement set forth in claim 9, wherein a dielectric layer is applied to the under surface of said substrate for sealing and surface passivation.

11. The arrangement set forth in claim 10, wherein said dielectric layer is a photolithographically patterned glass material suitable for thick film processing and subsequent metallization.

* * * * *